US006852071B2

(12) United States Patent
Balordi et al.

(10) Patent No.: US 6,852,071 B2
(45) Date of Patent: Feb. 8, 2005

(54) SYSTEMS AND METHODS FOR MAKING PAPERBOARD CONTAINERS

(75) Inventors: Romano Balordi, Millers, MD (US); David W. Norwood, Joppatowne, MD (US); Semyon Bekker, Baltimore, MD (US); Alvin C. Hartman, Baltimore, MD (US); Gregory Neal, Pasadena, MD (US)

(73) Assignee: Sweetheart Cup Company Inc., Owings Mills, MD (US)

( * ) Notice: Subject to any disclaimer, the term of this patent is extended or adjusted under 35 U.S.C. 154(b) by 0 days.

(21) Appl. No.: 10/430,389

(22) Filed: May 7, 2003

(65) Prior Publication Data

US 2004/0224829 A1 Nov. 11, 2004

(51) Int. Cl.[7] ..... B31B 1/90
(52) U.S. Cl. ..... 493/104; 493/108
(58) Field of Search ..... 493/104, 105, 493/106, 107, 108, 109, 149, 152; 156/443, 446, 499

(56) References Cited

U.S. PATENT DOCUMENTS

| | | | | |
|---|---|---|---|---|
| 3,111,063 A | * | 11/1963 | Herman | 493/190 |
| 3,249,024 A | | 5/1966 | Shiu | |
| 3,364,825 A | * | 1/1968 | Baumgartner | 493/107 |
| 3,439,590 A | * | 4/1969 | Crafton et al. | 493/107 |
| 3,475,243 A | | 10/1969 | Scalora | |
| 3,648,573 A | | 3/1972 | LeFebvre et al. | |
| 3,713,952 A | | 1/1973 | Schafer et al | |
| 3,977,306 A | | 8/1976 | Flynn | |
| 4,074,619 A | | 2/1978 | Feliks | |
| 4,147,494 A | | 4/1979 | Ando et al. | |
| 4,405,299 A | | 9/1983 | Serber | |
| 4,409,045 A | * | 10/1983 | Busse | 156/69 |
| 4,490,130 A | * | 12/1984 | Konzal et al. | 493/106 |
| 5,195,885 A | | 3/1993 | Medina | |
| 5,655,899 A | | 8/1997 | Hura et al. | |
| 5,992,489 A | * | 11/1999 | Busse | 156/443 |
| 6,022,213 A | | 2/2000 | Harthun | |
| 6,139,481 A | | 10/2000 | Norwood et al. | |

FOREIGN PATENT DOCUMENTS

JP 3-247914 11/1991

* cited by examiner

*Primary Examiner*—Eugene Kim

(57) ABSTRACT

Systems and methods for making a paperboard container include a sidewall blank heater assembly having upper and lower sidewall blank heaters for simultaneously heating upper and lower edge strips of the sidewall blank adjacent lateral edges thereof, and a bottom sidewall seam heater for heating a generally curved strip adjacent an arcuate bottom edge of the sidewall blank simultaneously with the upper and lower edge strips. The sidewall blank is thereafter curved about a forming mandrel at a container-forming station so as to overlap the heated upper and lower edge strips of the sidewall blank to form a longitudinal container side seam, while the bottom edge of the sidewall blank is brought into contact with a paperboard bottom wall blank to form an annular container bottom seam. A bottom seam heater assembly is most preferably provided for circumferentially heating the container bottom seam simultaneously while the sidewall blank is curved about the forming mandrel at the container-forming station. In such a manner, high quality, leak proof seams of the paperboard container ensue.

18 Claims, 11 Drawing Sheets

SYSTEMS AND METHODS FOR MAKING PAPERBOARD CONTAINERS

FIELD OF THE INVENTION

The present invention relates generally to container-forming systems and methods. In especially preferred embodiments, the present invention relates to gas-fired burner systems and methods which serve to seal seams of paperboard containers during manufacture.

BACKGROUND AND SUMMARY OF THE INVENTION

It is often necessary to apply localized heat in a very precise manner to heat portions of articles during the manufacture thereof. For example, some containers are made from paperboard having a polymeric coating therein (i.e., so-called polycoated paperboard). During manufacture of containers from such polycoated paperboard, therefore, it is necessary for localized regions thereof to be heated rapidly and accurately in order to form high quality, leak-proof seams. Heating of the paperboard serves to soften the polymeric coating thereon to such an extent that when cooled the overlapped regions of the paperboard will be bonded one to another in a leak-proof manner.

Various techniques are known generally in the art for the purpose of localized heating of polycoated paperboard during the manufacture of containers therefrom. For example, according to one prior art technique, compressed air is heated either electrically or by means of a gas-fired heater. The heated air is then routed to the localized regions of the polycoated paperboard by means of suitable ducting. (See in this regard, U.S. Pat. No. 6,022,213, the entire content of which is incorporated hereinto expressly by reference.)

More recently, in U.S. Pat. No. 6,139,481 to Norwood et al (the entire content of which is incorporated hereinto expressly by reference), there is disclosed a gas-fired heater which serves to heat localized regions of polycoated paperboard directly. Direct localized heating of the polycoated board has a significant cost advantage over the indirect heating (e.g., using heated compressed air) techniques of the prior art. However, as larger containers are attempted to be manufactured, there exists a real nontrivial problem to ensure that the entire bottom wall seam is adequately heated and thus sealed sufficiently to prevent leakage.

It would therefore be highly desirable if gas-fired heaters could be provided for the direct localized heating of relatively large-sized polycoated paperboard containers during manufacture. It is therefore towards fulfilling such a need that the present invention is directed.

Broadly, the present invention is embodied in systems and methods for making a paperboard container wherein lateral side and the arcuate bottom edge regions of a paperboard sidewall blank may be heated simultaneously. In especially preferred embodiments, a sidewall blank heater assembly is provided having upper and lower sidewall blank heaters for simultaneously heating upper and lower edge strips of the sidewall blank adjacent lateral edges thereof, and a bottom sidewall seam heater for heating a generally curved strip adjacent an arcuate bottom edge of the sidewall blank simultaneously with the upper and lower edge strips. The sidewall blank is thereafter curved about a forming mandrel at a container-forming station so as to overlap the heated upper and lower edge strips of the sidewall blank to form a longitudinal container side seam, while the bottom edge of the sidewall blank is brought into contact with a paperboard bottom wall blank to form an annular container bottom seam. A bottom seam heater assembly is most preferably provided for circumferentially heating the container bottom seam simultaneously while the sidewall blank is curved about the forming mandrel at the container-forming station. In such a manner, high quality, leak proof seams of the paperboard container ensue.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
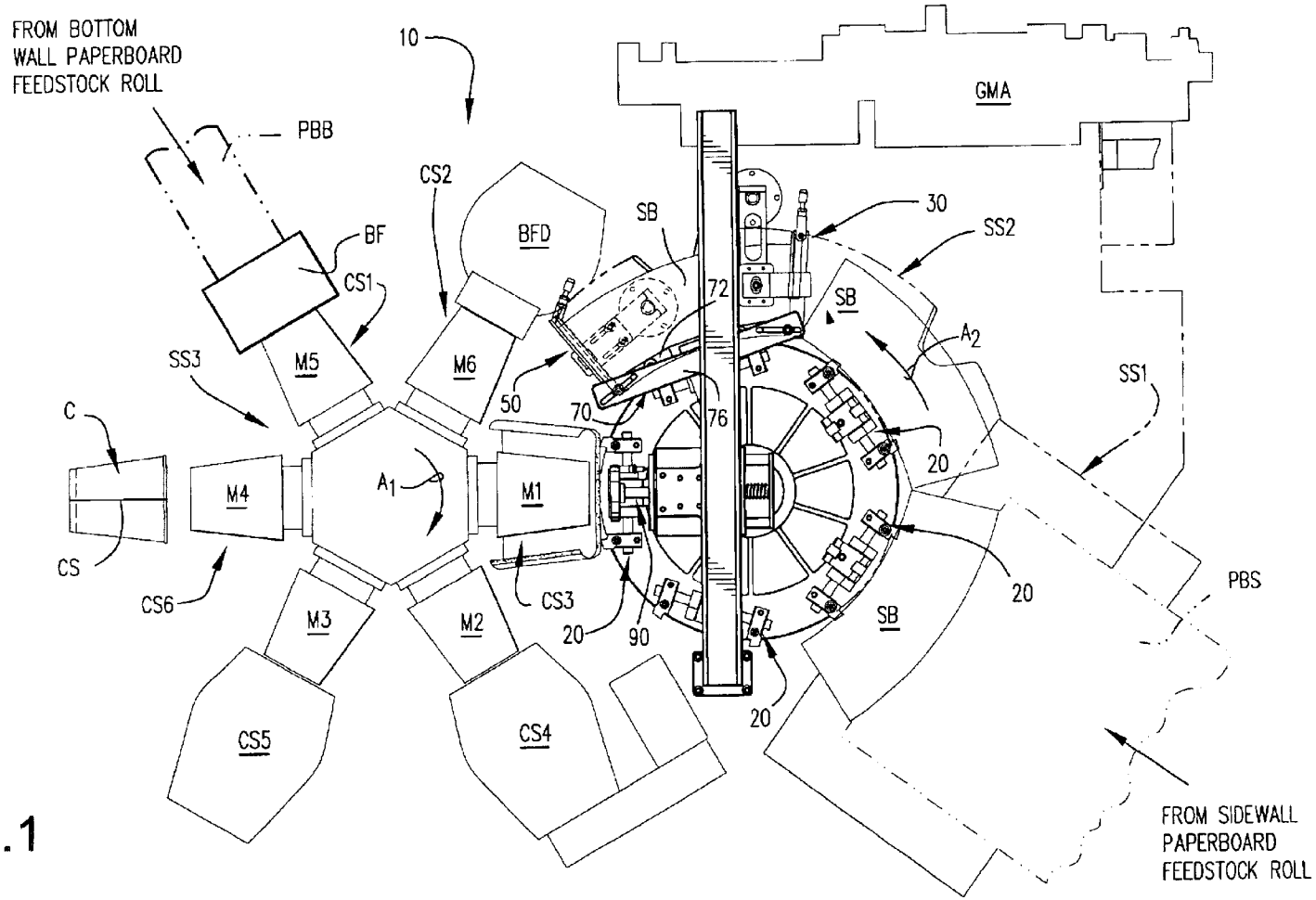
FIG. 1 is a top plan view showing a particularly preferred system for making paperboard containers which embodies the present invention.

Accompanying FIG. 1 depicts in a schematic manner a particularly preferred container-forming system 10 in accordance with the present invention. As shown, the system 10 includes a side wall blank forming subsystem SS1, a sidewall feed turret subsystem SS2, and a container forming turret subsystem SS3. The container-forming turret subsystem SS3 is provided with a plurality of mandrels M1–M6 which are rotationally indexed in the direction of arrow A1 through container forming stations CS1–CS6 synchronously with the rotational indexing of the sidewall feed turret subsystem SS2 in the direction of arrow A2. It will be appreciated, of course, that the mandrels M1–M6 are each indexed separately through the respective container forming stations CS1–CS6. Thus, the state of operation of the system 10 just happens to be shown with mandrels M1–M6 in a corresponding respective one of the stations CS1–CS6.

As is well known, the sidewall blanks SB are punched from a sheet of paperboard PB being fed from a paperboard feedstock roll (not shown). The sidewall blanks SB are thus sequentially grabbed by transfer fingers 20 associated with the sidewall feed turret subsystem SS2. The feed turret subsystem SS2 thus rotates in the direction of arrow A1 so as to present each of the sidewall blanks SB sequentially to the container-forming station CS3 which, in the state of the system 10 depicted in FIG. 1, is occupied by mandrel M1 associated with the container forming turret subsystem SS3.

The sidewall feed turret subsystem SS2 presents the sidewall blanks SB to upper and lower side seam heater assemblies 30, 50, respectively, and a bottom sidewall seam heater assembly 70. The side seam heater assemblies 20, 30 serve to heat localized upper and lower strip regions of the polymeric coating on the sidewall blanks SB adjacent their respective lateral edges, respectively. Thus, when subsequently indexed to the container forming station CS3 (occupied by mandrel M1 in the state of the system 10 depicted in FIG. 1), these heated upper and lower strip regions will be juxtaposed one on top of the other so that when the polymeric coating cools, a high quality leak-proof side seam CS on the resulting container C discharged from the container discharge station CS6.

The bottom seam heater assembly 70 supplies heat along a generally arcuate region adjacent the curved bottom edge of the side wall blank SB. Heating of such arcuate region adjacent the curved bottom edge of the side wall blank will thus facilitate the joining of the bottom wall blank (not shown) to the side wall blank SB at the container forming station CS3. In addition, the bottom wall seam associated with the bottom wall blank is heated simultaneously with the sidewall formation at container forming station CS3 by means of the bottom wall seam heater assembly 90.

As is conventional, a bottom wall blank (not shown) is punched via bottom wall blank former BBF from a sheet of bottom wall paperboard feedstock PBB fed from a roll thereof (not shown) and positioned at the end of mandrel M5 which, in the state of the system 10 depicted in FIG. 1, occupies container forming station CS1. At the downstream container forming station CS2 (occupied by mandrel M6 in the state of the system 10 depicted in FIG. 1), a bottom wall forming die BFD is brought into contact with the bottom wall blank so as to form a bottom wall seam flange adapted to mate with the bottom edge region of the sidewall blank SB when formed into a conically shaped sidewall at station CS3. Thus, advancement of the bottom wall seam heater 90 into operative position with the bottom wall (as will be described in greater detail below) at station CS3 will serve to heat the polymeric coating on the bottom wall blank. This additional heating provided to the bottom wall blank, in addition to the heating of the sidewall blank SB along its bottom arcuate edge by means of the heater assembly 70 thereby ensures that a high-quality leak proof bottom seam is formed at the bottom seaming operations associated with stations CS4 and CS5 (occupied by mandrels M2 and M3 respectively in the state of the system 10 depicted in FIG. 1). The thus formed container C may then be ejected from mandrel M4 (e.g., via well known pneumatic conveyance means) which, in the state of the system 10 depicted in FIG. 1, occupies the container forming station CS6.

Figure 2:
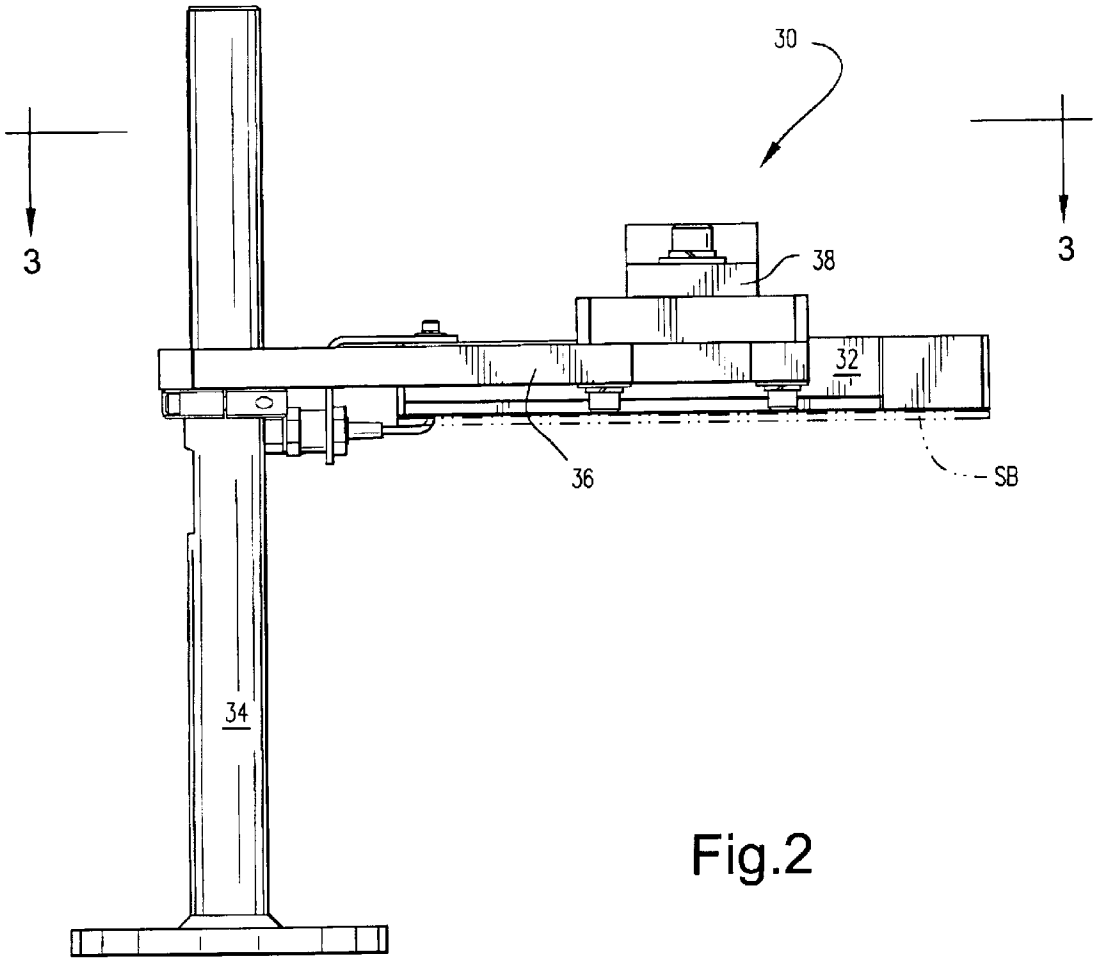
FIG. 2 is an elevational view of the upper side seam heater employed in the system of FIG. 1.
Figure 3:
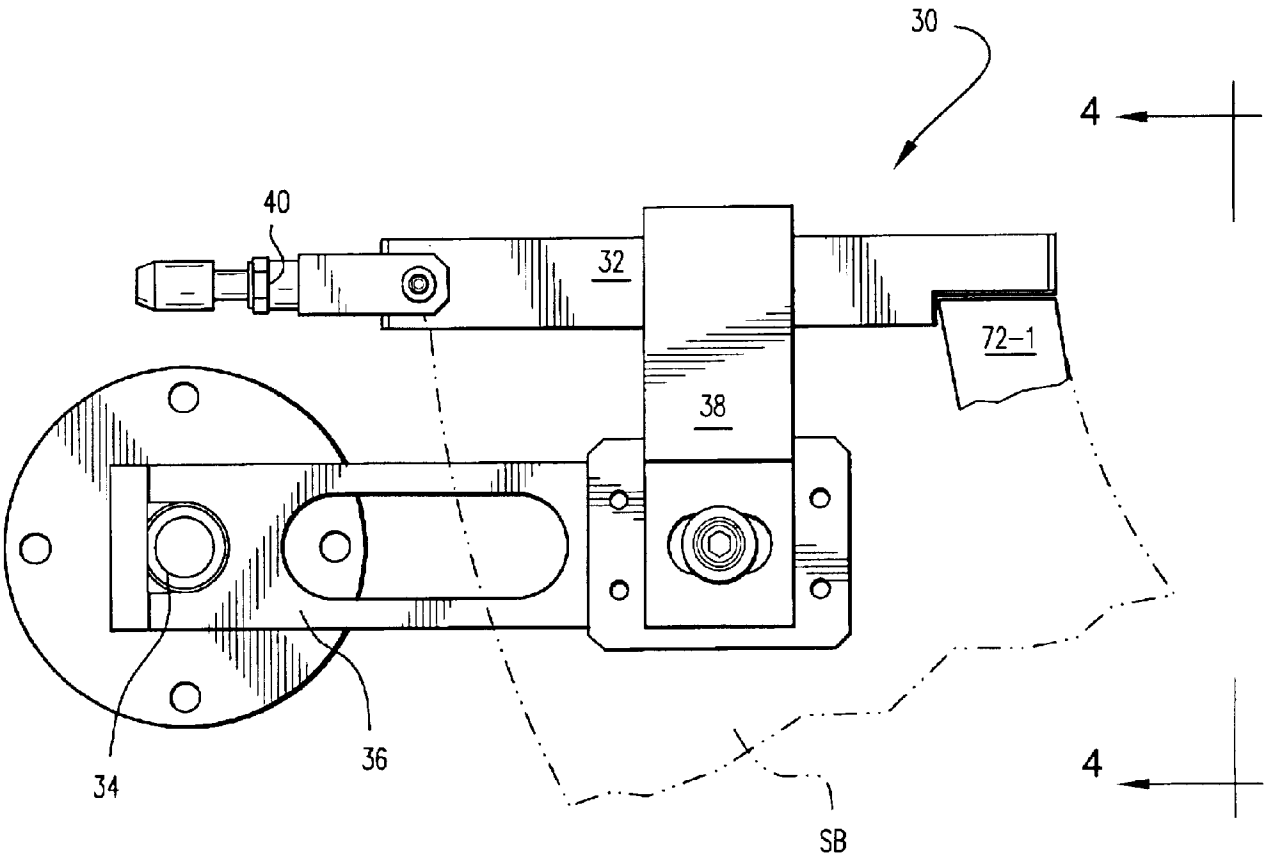
FIG. 3 is a top plan view of the upper side seam heater depicted in FIG. 2 as taken along line 3—3 therein.
Figure 4:
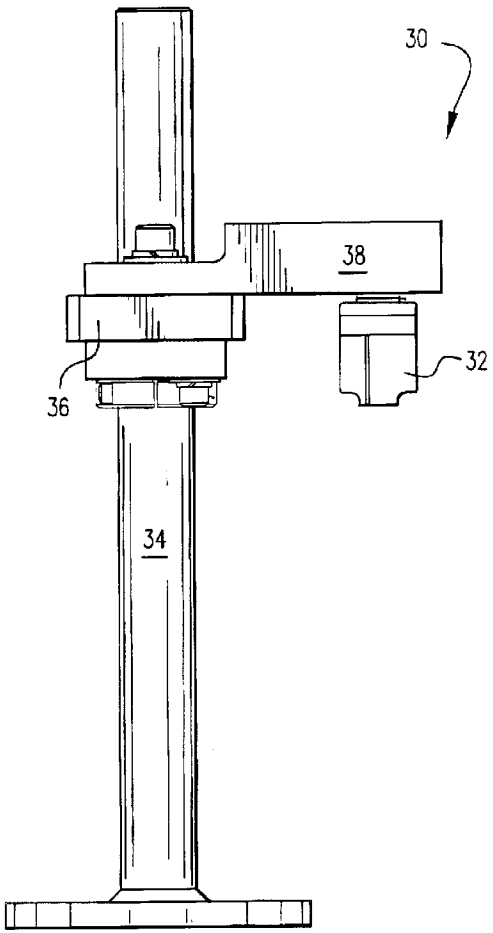
FIG. 4 is an end elevational view of the upper side seam heater depicted in FIGS. 2 and 3 as taken along line 4—4 in FIG. 3.
Figure 5:
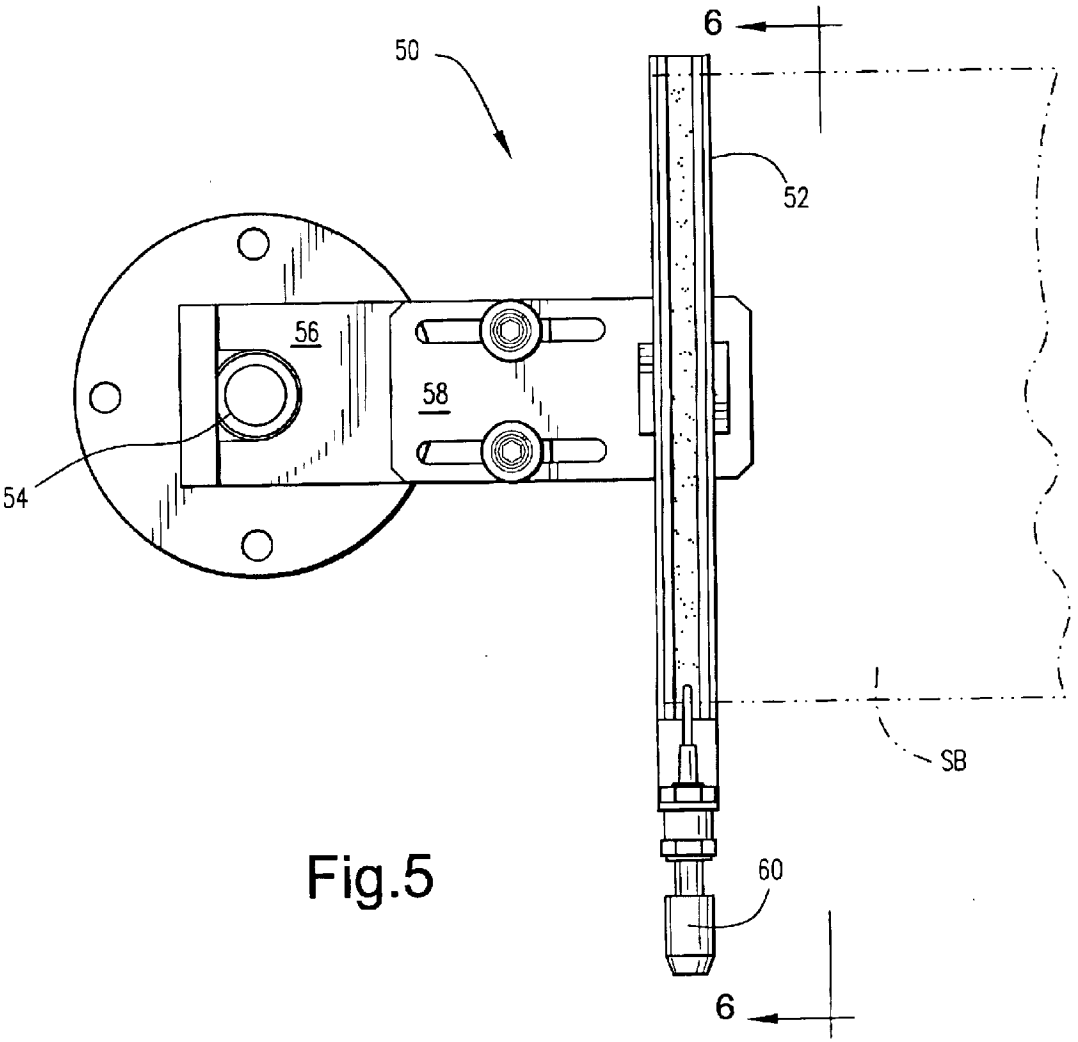
FIG. 5 is a top plan view of the lower side seam heater employed in the system of FIG. 1.
Figure 6:
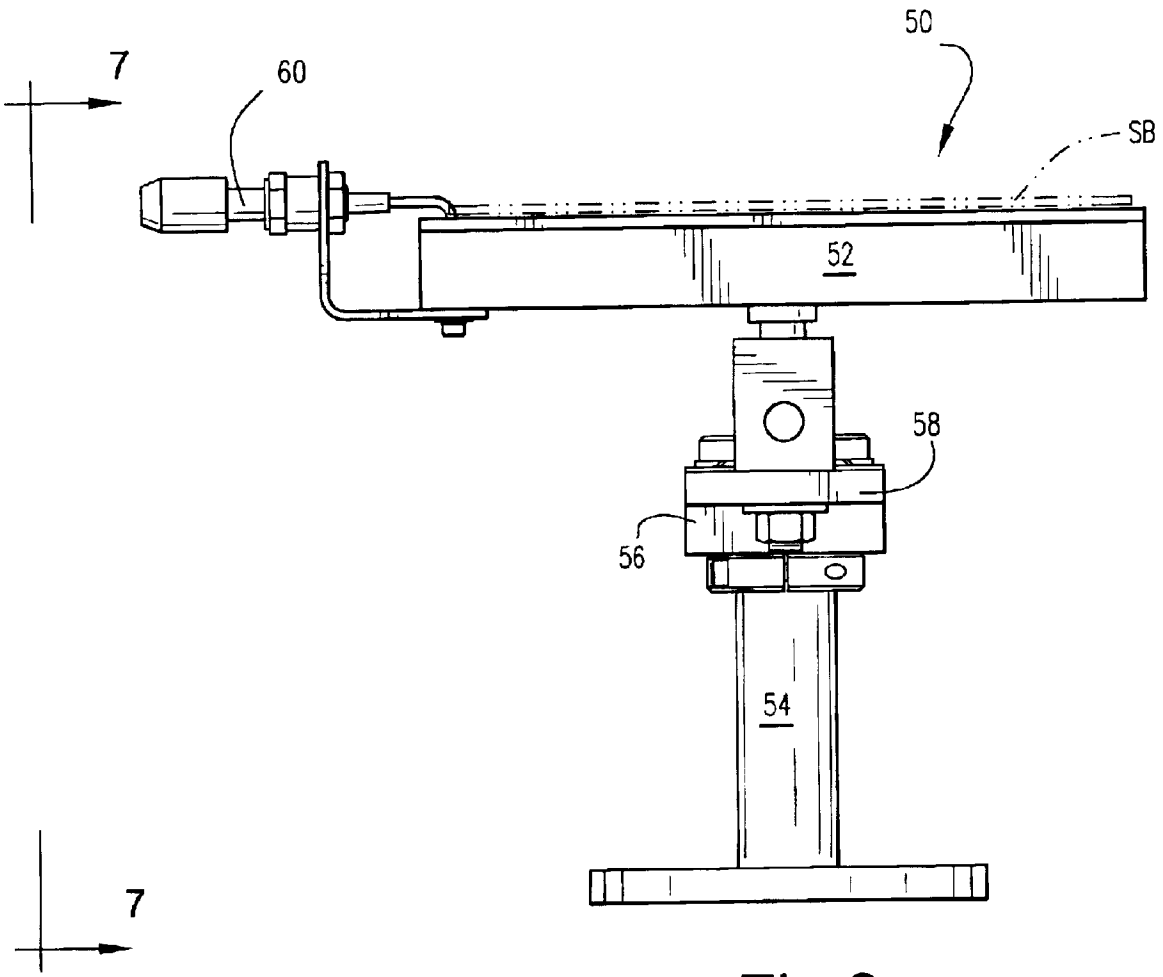
FIG. 6 is an elevational view of the lower side seam heater depicted in FIG. 5 as taken along line 6—6 therein.
Figure 7:
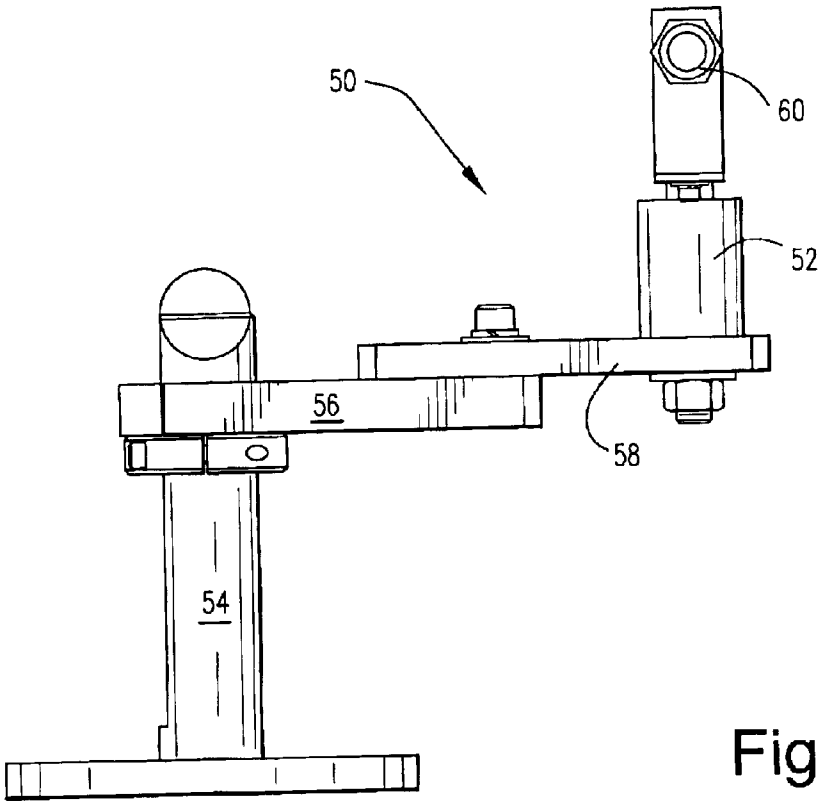
FIG. 7 is an end elevational view of the lower side seam heater depicted in FIGS. 5 and 6 as taken along line 7—7 in FIG. 6.

The upper side seam heater 30 is shown in an enlarged manner in accompanying FIGS. 2–4. The heater 30 is generally comprised of an elongate apertured tubular heater bar 32 which is supported rigidly by means of support post 34 and support arms 36, 38 so as to be disposed in close proximity over the sidewall blank SB (shown in phantom line in FIGS. 2 and 3). A combustible mixture of natural gas and air is supplied to the interior of the heater bar 32 from the gas manifold assembly GMA (see FIG. 1) and combusted therein. Flames from such combustion process will therefore be directed out of the apertures of the heater bar 32 in very close proximity to a lateral edge of the sidewall blank SB located therebeneath. In such a manner, a strip of the polymeric coating on the upper surface of the sidewall blank SB facing the heater bar 32 will be heated in advance of sidewall formation. A flame sensor 40 is provided and is electrically interconnected to the gas manifold assembly GMA so as to terminate supply of combustible gas to the heater bar in the event that no flame is detected.

In a similar manner, the lower side seam heater 50 is provided so as to heat a strip of polymeric coating on a lower surface of the sidewall blank SB facing the apertured tubular heater bar 52 thereof. Thus, as shown in the accompanying FIGURES, the surfaces of the sidewall blank facing each of the upper and lower side seam heaters 30, 50 will ultimately become the inner and outer surfaces of the container C. The heater bar 52 of the lower side seam heater 50 is thus supported in close proximity to the left side seam of the sidewall blank SB by means of support post 54, and support arms 56, 58. A flame sensor 60 is provided and is electrically interconnected to the gas manifold assembly GMA so as to terminate supply of combustible gas to the heater bar in the event that no flame is detected.

Figure 8:
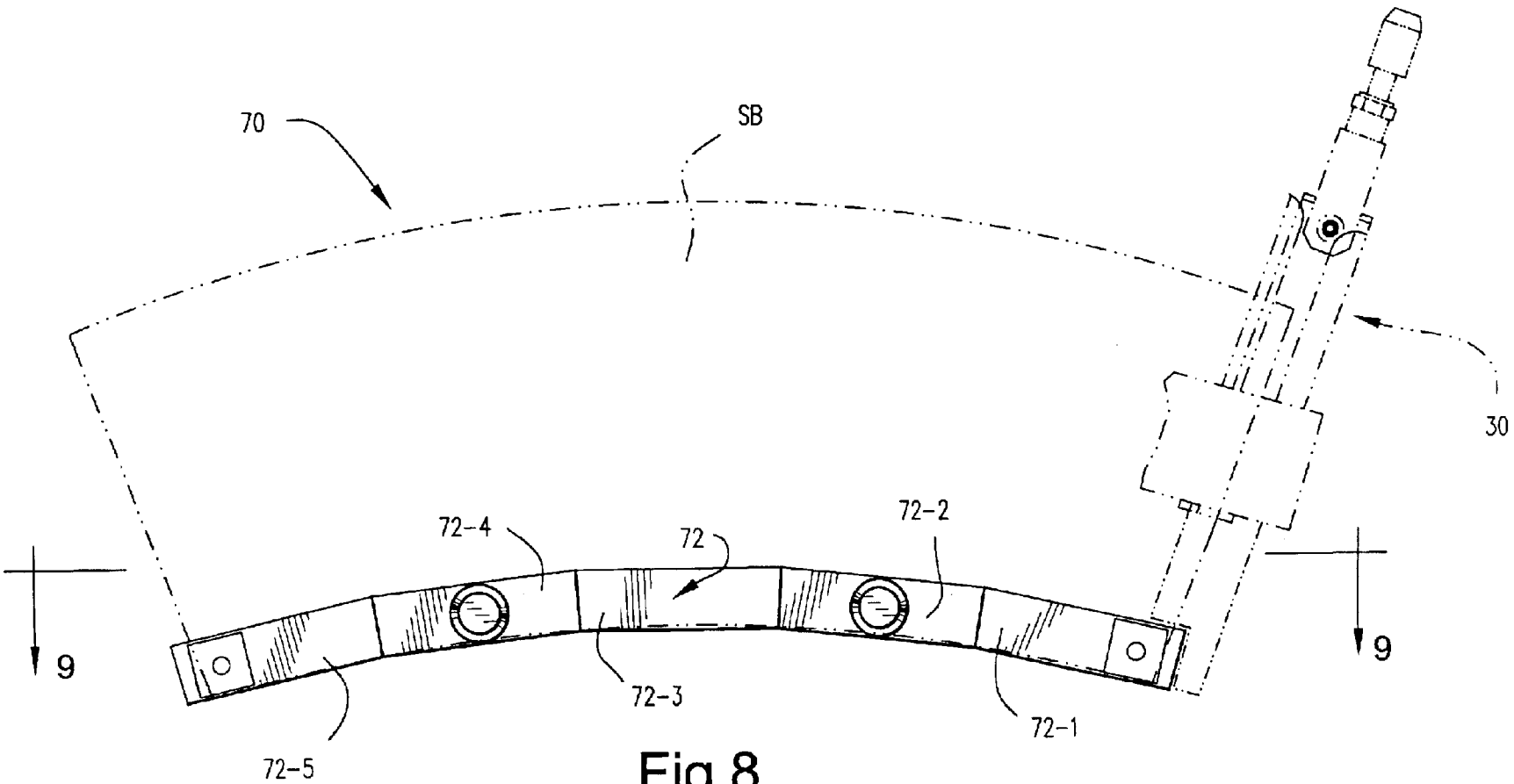
FIG. 8 is a top plan view of the bottom sidewall seam heater assembly employed in the system of FIG. 1.
Figure 9:
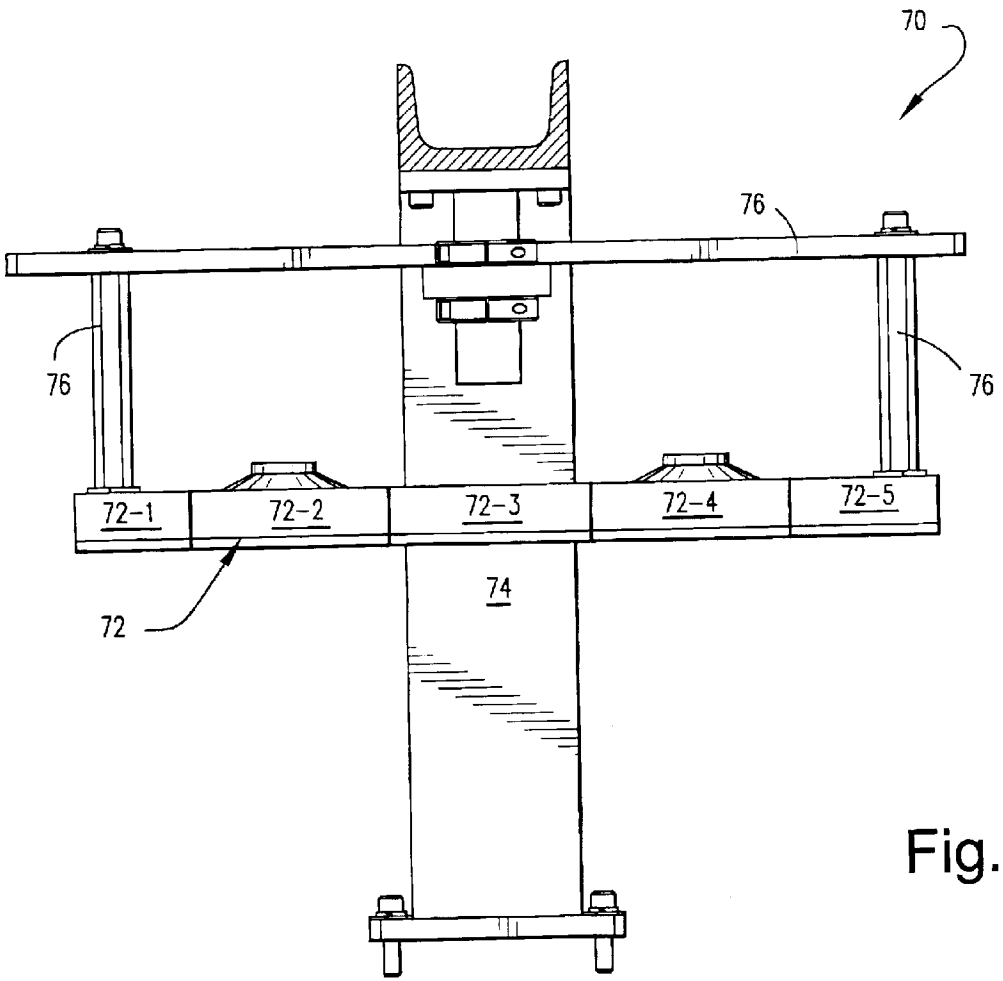
FIG. 9 is an elevational view of the bottom sidewall seam heater depicted in FIG. 8 as taken along line 9—9 therein.

One end of the heater bar 72 associated with the bottom sidewall seam heater 70 is nested within a recess 32-1 of the heater bar 32 associated with the upper side seam heater 30 (see FIG. 3). As shown in FIGS. 8 and 9, the heater bar 72 is itself comprised of elongate apertured tubular sections 72-1 through 72-5 which are rigidly angularly joined one to another so as to be in general conformance to the arcuate bottom edge of the sidewall blank SB. The heater bar 72 is therefore dependently supported by means of the upright support beam 74, support plate 76 and support posts 76 so as to positioned in close proximity physically over a generally arcuate strip adjacent the bottom edge of the sidewall blank SB.

Collectively, therefore the heaters 30, 50 and 70 serve to heat simultaneously regions of the sidewall blank prior to formation of the container C so that when formed, high quality leak proof seams are provided. Following such simultaneous heating of the sidewall blank SB by means of the heaters 30, 50 and 70, the sidewall feed turret subsystem SS2 will then be indexed so as to present the heated sidewall blank SB to the container forming station CS3. As briefly described above in reference to FIG. 1, the sidewall blank SB will be curved about the mandrel at the container forming station CS3 (which as noted previously is occupied by mandrel M1 in the system state depicted in FIG. 1). As can be appreciated, the heated lateral edge strips on the upper and lower surfaces of the sidewall blank SB accomplished by means of the heaters 30 and 50, respectively, will be overlapped and brought in to contact with one another thereby forming the container seam CS. At the same time, the heated arcuate bottom edge strip of sidewall blank will be brought into contact with a portion of the bottom wall blank. In order to ensure that the bottom seam of the container C is leak proof, further heating of the bottom wall seam is accomplished according to the present invention by means of the bottom wall seam heater assembly 90 which is depicted in greater detail in accompanying FIGS. 10 and 11.

The bottom wall seam heater assembly 90 includes a generally hollow heater disc 92 having flame apertures formed in its circumferential side wall. The heater disc 92 is supported at the forward end of a supply conduit 94 which is connected operatively to the gas supply manifold assembly GSA which serves to supply a combustible gas to the interior of the disc 92. An igniter 96 is provided to ignite the gas within the disc 92 so that flames from such combustion extend radially outwardly of the disc 92 through its sidewall apertures.

Figure 11:
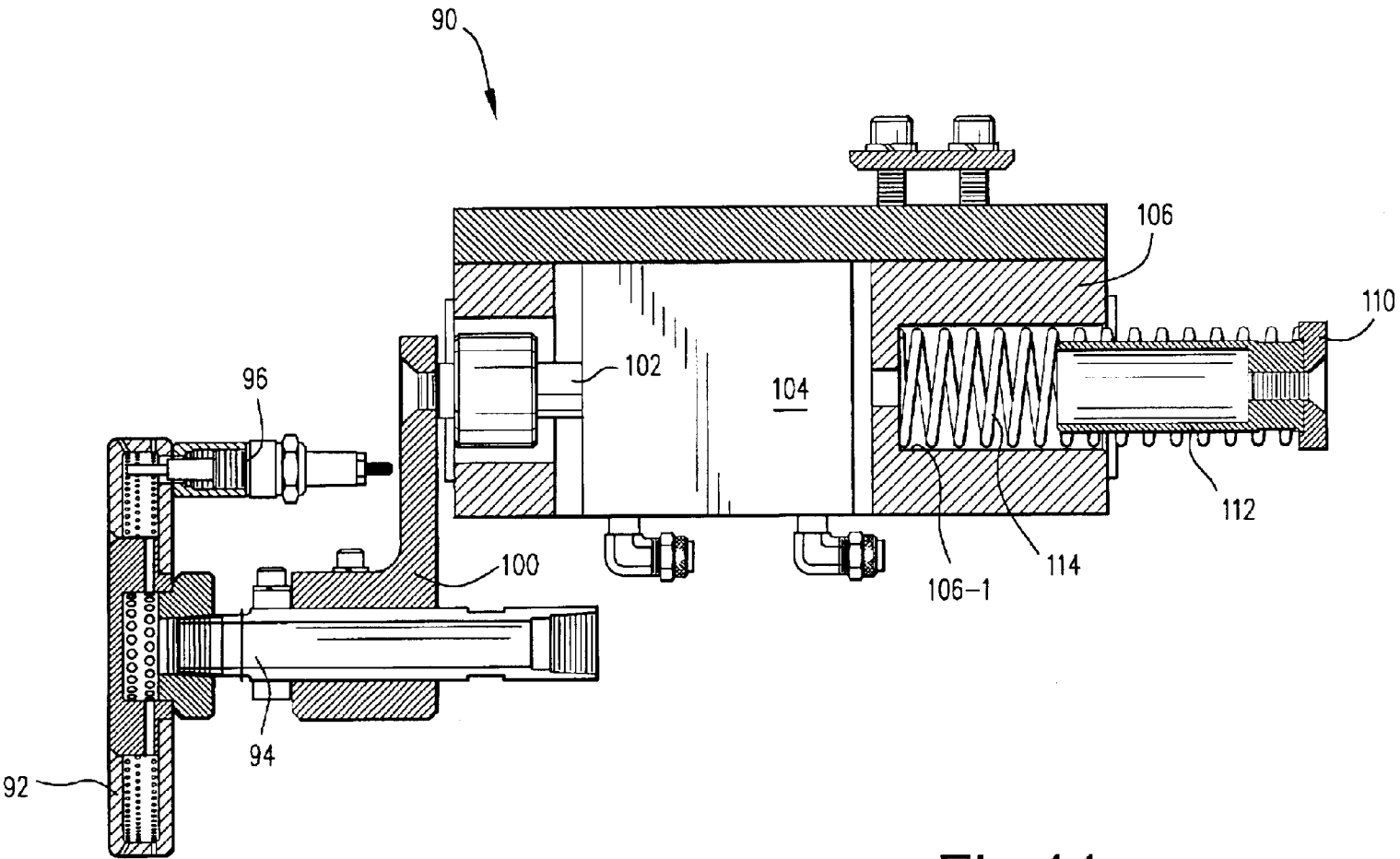
FIG. 11 is a cross-sectional elevational view of the bottom wall seam heater assembly depicted in FIG. 10 as taken along line 11—11 therein.

The gas supply conduit 94 is supported and carried by an L-shaped bracket 100 attached to the forward end of an actuator rod 102 assocaited with air-operated cylinder 104 housed within the body 106 of the heater assembly 90. The bracket 100 is also attached to the forward ends of guide rods 108-1, 108-2 which are mounted for reciprocal sliding movements through the body 106. The rear ends of the rods 108-1, 108-2 are connected rigidly to a bridge plate 110 which carries a support post 112 for the compression spring 114. As shown in FIG. 11, the spring 114 is seated within recess 106-1 of the body 106 and thus acts on the bridge plate 110.

Figure 10:
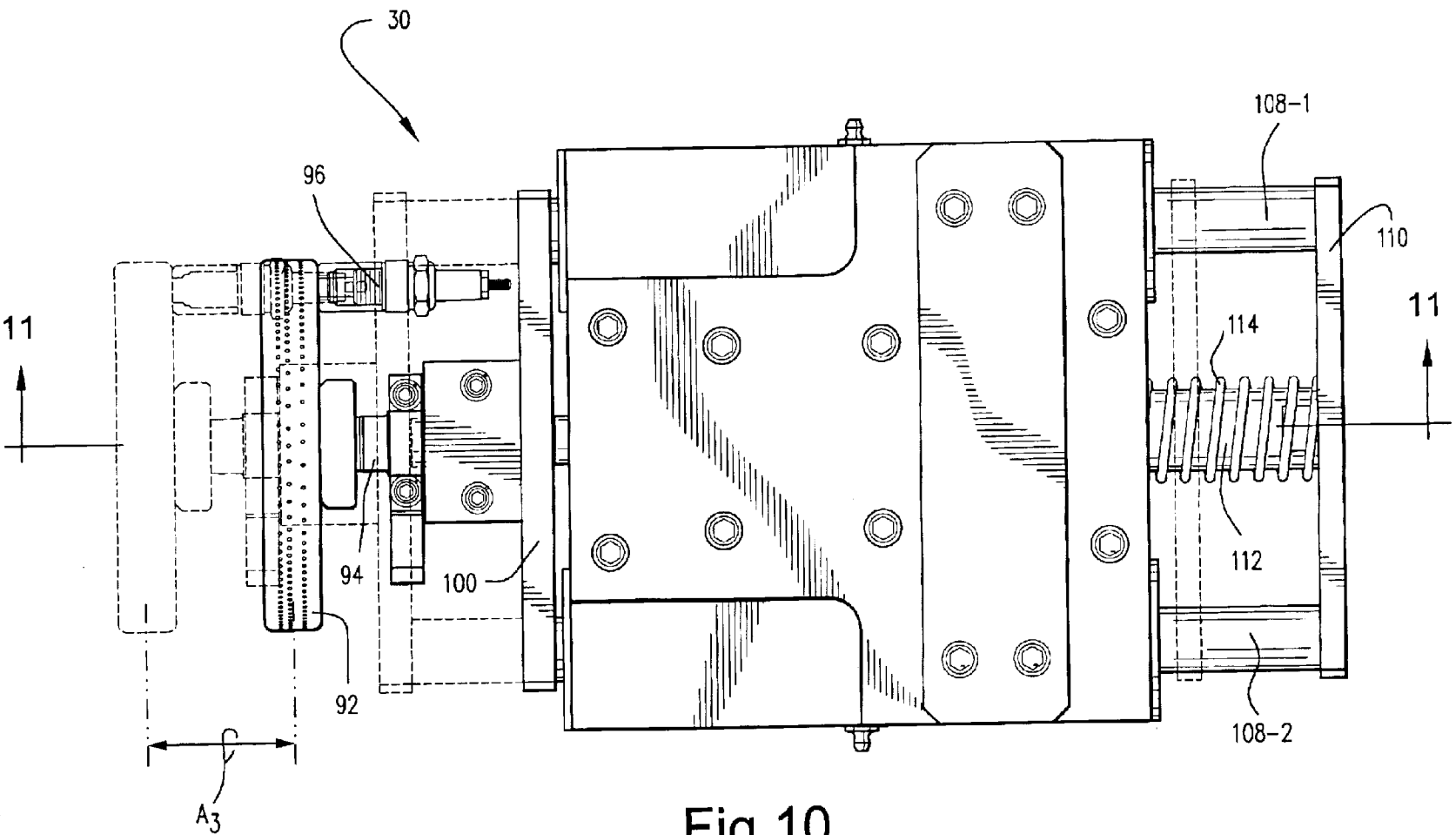
FIG. 10 is a top plan views of the bottom wall seam heater assembly in accordance with the present invention.

The bracket 100, and hence the heater disc 92, is therefore capable of being reciprocally moved between retracted and advanced positions as shown in solid and phantom lines, respectively in FIG. 10. Thus, the heater disc 92 is adapted to being reciprocally moved a distance (arrow A3 in FIG. 10) between a retracted position, wherein the heater disc is spaced from the bottom wall of the container when in the container forming station CS3, and an advanced position, wherein the heater disc 92 is nested within the bottom wall of the container when in the container forming station CS3. Therefore, when in the advanced position, the bottom wall seam will circumferentially bound the apertured sidewall of the disc 92 so that the flames emanating therefrom will be brought into close proximity with the bottom wall seam thereby heating the same. Moreover, such advancement of the heater disc 92 and heating of the bottom wall seam occurs simultaneously when the sidewall blank SB is being curved about the forming mandrel (e.g., mandrel M1) when in the container forming station CS3. Such bottom wall seam heating, coupled with the heating provided by means of the bottom sidewall seam heater 70 will ensure that leakproof bottom seams are provided in the container C when the bottom seam is formed at stations CS4 and CS5.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a paperboard container comprising the steps of:

(a) simultaneously heating upper and lower strips of a sidewall blank adjacent lateral edges thereof and a generally curved strip adjacent an arcuate bottom edge thereof;

(b) curving the sidewall blank about a forming mandrel so as to overlap said heated upper and lower strips of the sidewall blank to form a longitudinal container side seam, while contacting the bottom edge of the sidewall blank with a paperboard bottom wall blank to form an annular container bottom seam; and (c) simultaneously with step (b), circumferentially heating the container bottom seam.

2. The method of claim 1, wherein step (a) is practiced using gas-fired heater bars.

3. The method of claim 1 or 2, wherein step (c) is practiced using a gas-fired heater disc.

4. The method of claim 3, wherein the heater disc is moved between a retracted position wherein the heater disc is spaced from the bottom seam, and an advanced position wherein the heater disc is nested within the bottom seam.

5. The method of claim 4, wherein the step (c) is practiced by providing apertures circumferentially in the heater disc and allowing flames to emanate therefrom so as to circumferentially heat the bottom seam when the heater disc is in said extended position thereof.

6. A method of making a paperboard container comprising the steps of:

(a) providing a paperboard sidewall blank having opposed lateral edges and arcuate top and bottom edges joining said lateral edges thereof;

(b) simultaneously heating (i) an upper edge strip of the sidewall blank adjacent one lateral edge thereof, (ii) a lower edge strip of the sidewall blank adjacent the other lateral edge thereof, and (iii) a generally curved strip of the sidewall blank adjacent said actuate bottom edge thereof;

(c) curving the paperboard sidewall blank about a forming mandrel so as to overlap the lateral edges thereof and bring the heated upper and lower edge strips into overlapping adjacent contact with one another to thereby form a longitudinal container side seam, while contacting the heated generally curved strip adjacent the arcuate bottom edge thereof with a paperboard bottom wall blank to form an annular container bottom seam; and (d) simultaneously with step (c), circumferentially heating the container bottom seam.

7. The method of claim 6, wherein step (d) comprises moving a heater disc between a retracted position wherein the heater disc is spaced from the bottom seam, and an advanced position wherein the heater disc is nested within the bottom seam.

8. The method of claim 7, wherein the step (d) is practiced by providing apertures circumferentially in the heater disc and allowing flames to emanate therefrom so as to circumferentially heat the bottom seam when the heater disc is in said extended position thereof.

9. A system for making a paperboard container comprising:

(a) a sidewall blank heater assembly comprised of upper and lower sidewall blank heaters for simultaneously heating upper and lower edge strips of the sidewall blank adjacent lateral edges thereof, and a bottom sidewall seam heater for heating a generally curved strip adjacent an arcuate bottom edge of the sidewall blank simultaneously with said upper and lower edge strips;

(b) a container-forming station for curving the sidewall blank about a forming mandrel so as to overlap said heated upper and lower edge strips of the sidewall blank to form a longitudinal container side seam, while contacting the bottom edge of the sidewall blank with a paperboard bottom wall blank to form an annular container bottom seam; and (c) a bottom seam heater assembly for circumferentially heating the container bottom seam simultaneously while the sidewall blank is curved about the forming mandrel at the container-forming station.

10. The system of claim 9, wherein said sidewall blank heater assembly comprises upper and lower gas-fired tubular heater bars for heating said upper and lower edge strips.

11. The system of claim 9 or 10, wherein said bottom seam heater assembly comprises a gas-fired heater disc.

12. The system of claim 11, wherein the heater disc is mounted for movements between a retracted position wherein the heater disc is spaced from the bottom seam, and an advanced position wherein the heater disc is nested within the bottom seam.

13. The system of claim 12, wherein the heater disc includes circumferentially disposed apertures for allowing flames to emanate therefrom so as to circumferentially heat the bottom seam when the heater disc is in said extended position thereof.

14. A system for making a paperboard container from a paperboard sidewall blank having opposed lateral edges and arcuate top and bottom edges joining the lateral edges thereof, and a paperboard bottom wall blank, said system comprising:

(a) sidewall blank heater means for simultaneously heating (i) an upper edge strip of the sidewall blank adjacent one lateral edge thereof, (ii) a lower edge strip of the sidewall blank adjacent the other lateral edge thereof, and (iii) a generally curved strip of said sidewall blank adjacent said actuate bottom edge thereof;

(b) container-forming means having a forming mandrel for curving the sidewall blank about said forming mandrel so as to overlap the lateral edges of the sidewall blank and bring the heated upper and lower edge strips into overlapping adjacent contact with one another to thereby form a longitudinal container side seam, while contacting the heated generally curved strip adjacent the arcuate bottom edge thereof with the paperboard bottom wall blank to form an annular container bottom seam; and (c) bottom seam heater means for circumferentially heating the container bottom seam at said container-forming means simultaneously while curving the sidewall blank about said forming mandrel thereat.

15. The system of claim 14, wherein said bottom seam heater means includes a heater disc which is mounted for reciprocal movements between a retracted position wherein the heater disc is spaced from the bottom seam, and an advanced position wherein the heater disc is nested within the bottom seam.

16. The system of claim 15, wherein the heater disc includes circumferential apertures for allowing flames to emanate therefrom so as to circumferentially heat the bottom seam when the heater disc is in said extended position thereof.

17. The system of claim 15, wherein said sidewall blank heater means is comprised of upper and lower sidewall blank heaters for simultaneously heating the upper and lower edge strips of the sidewall blank adjacent the lateral edges thereof.

18. The system of claim 17, wherein said sidewall blank heater means is further comprised of a bottom sidewall seam heater for heating the generally curved strip adjacent the arcuate bottom edge of the sidewall blank simultaneously with said upper and lower edge strips.

* * * * *